US008147279B1

(12) United States Patent
Martin et al.

(10) Patent No.: US 8,147,279 B1
(45) Date of Patent: Apr. 3, 2012

(54) ELECTRICAL CONNECTOR HAVING OVERSTRESS PROTECTION

(75) Inventors: Galen M. Martin, Camp Hill, PA (US); Hurley Chester Moll, Hershey, PA (US); John Raymond Shuey, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/073,290

(22) Filed: Mar. 28, 2011

(51) Int. Cl.
*H01R 13/514* (2006.01)

(52) U.S. Cl. ..... 439/752; 439/346; 439/595

(58) Field of Classification Search ..... 439/752, 439/346, 595
See application file for complete search history.

(56) References Cited

U.S. PATENT DOCUMENTS 4,758,182 A * 7/1988 Anbo et al. ..... 439/592
5,059,142 A * 10/1991 Ohta et al. ..... 439/752
5,123,866 A * 6/1992 Endo et al. ..... 439/752
5,454,740 A * 10/1995 Sakano et al. ..... 439/752
6,106,340 A * 8/2000 Myer et al. ..... 439/752
6,869,555 B2 * 3/2005 Kashiyama ..... 264/238
7,004,790 B2 * 2/2006 Martin et al. ..... 439/595
7,066,773 B1 * 6/2006 Martin ..... 439/752
7,625,251 B2 * 12/2009 Martin et al. ..... 439/752
2005/0266738 A1 * 12/2005 Martin et al. ..... 439/751

* cited by examiner

*Primary Examiner* — Tulsidas C Patel
*Assistant Examiner* — Vladimir Imas

(57) ABSTRACT

An electrical connector includes a housing having a plurality of terminal passages. Each terminal passage has a deflectable latch for securing the terminal within the passage and is configured to permit an electrical terminal to be inserted into the passage. Openings are provided proximate the deflectable latches, with each opening extending from a first terminal passage of the plurality of terminal passages to an adjacent second terminal passage. Projections extend from side surfaces of the terminal passages, with at least one projection extending into each terminal passage. At least one projection is positioned to cooperate with a side surface of a respective deflectable latch to prevent the deflectable latch from being overstressed. The openings and the projections allow the terminal passages to be closely spaced thereby reducing the size of the connector while providing overstress protection for the deflectable latches.

20 Claims, 6 Drawing Sheets

ELECTRICAL CONNECTOR HAVING OVERSTRESS PROTECTION

FIELD OF THE INVENTION

The present invention is directed to overstress protection for a resilient or deflectable latch, and in particular, to overstress protection in instances in which terminals are positioned on close centerlines.

BACKGROUND OF THE INVENTION

In a conventional electrical connector, a housing includes a front end, a rear end and a plurality of terminal receiving passages extending between the front and rear ends. Terminals, such as female contact terminals, are inserted into the rear ends of the passages. Each passage includes a latch that deflects outwardly in the passage to allow the terminal to be inserted into the passage. Once the terminal is fully inserted into the passage, the latch flexes inwardly to lock the terminal into the passage.

Known electrical connectors include terminal position assurance devices (TPA) that mate with the connector housing for movement between a partially engaged position and a fully engaged position. The TPA presents wedges that extend into the plug housing at locations adjacent to the terminal passages. When the TPA is at its partially engaged position, the wedges are fully withdrawn from the latches so the latches can flex outwardly sufficiently to permit the terminals to be inserted into the passages. When the TPA is moved to its fully engaged position, the wedges slide into positions underlying the latches, so as to bias the latches inwardly in order to retain the terminals in the passages. In order to prevent overflexing of the latches, the housing typically includes overstress features that limit outward deflection of the latches as the terminals are inserted into the housing and/or during removal of the terminals from the housing. Typically, these overstress features are in the form of separate walls or members formed on the housing at locations adjacent to the latches.

The quest to make electronic devices ever more compact has sparked a related desire to produce compact electrical connectors. Space is at a premium on these electrical connectors. Thus the ability to shrink, eliminate, or increase the efficiency of any component is highly desirable. However, forming the overstress features integrally with the housing increases the overall size of the connector.

A need remains for improved connector assemblies that overcome the problems discussed above. The preferred embodiments of the present invention described below address the above discussed needs and other disadvantages of conventional connector devices that will become readily apparent from the following description, drawings and claims.

SUMMARY OF THE INVENTION

An exemplary embodiment of an electrical connector includes a housing which has a plurality of terminal passages. Each terminal passage has a deflectable latch for securing the terminal within the passage and is configured to permit an electrical terminal to be inserted into the passage. Openings are provided proximate to the deflectable latches, with each opening extending from a first terminal passage of the plurality of terminal passages to an adjacent second terminal passage. Projections are provided in the plurality of terminal passages and are positioned proximate the openings. At least one projection extends into each terminal passage and is positioned to cooperate with a side surface of a respective deflectable latch to prevent the deflectable latch from being overstressed. The openings and the projections allow the terminal passages to be closely spaced thereby reducing the size of the connector while providing overstress protection for the deflectable latches.

Another exemplary embodiment of an electrical connector includes a housing having a plurality of terminal passages. Each terminal passage has a deflectable latch for securing the terminal within the passage and is configured to permit an electrical terminal to be inserted into the passage. Openings are provided proximate the deflectable latches, with each opening extending from a first terminal passage of the plurality of terminal passages to an adjacent second terminal passage. Projections extend from side surfaces of the terminal passages, with at least one projection extending into each terminal passage. At least one projection is positioned to cooperate with a side surface of a respective deflectable latch to prevent the deflectable latch from being overstressed. The openings and the projections allow the terminal passages to be closely spaced thereby reducing the size of the connector while providing overstress protection for the deflectable latches.

Another exemplary embodiment of an electrical connector includes a housing having a plurality of terminal passages. Each terminal passage has a deflectable latch for securing the terminal within the passage and is configured to permit an electrical terminal to be inserted into the passage. Openings are provided proximate to the deflectable latches, with each opening extending from a first terminal passage of the plurality of terminal passages to an adjacent second terminal passage. Projections extend from side surfaces of the terminal passages. The projections have beveled surfaces which engage the deflectable latches to prevent the overstress of the deflectable latches during the removal of the terminals. The openings and the projections allow the terminal passages to be closely spaced thereby reducing the size of the connector while providing overstress protection for the deflectable latches.

Other features and advantages of the present invention will be apparent from the following more detailed description of the preferred embodiment taken in conjunction with the accompanying drawings which illustrate, by way of example, the principles of the invention.

DETAILED DESCRIPTION OF THE INVENTION

In the following detailed description, numerous specific details are set forth in order to provide a thorough understanding of various embodiments. However, those skilled in the art will understand that the embodiments may be practiced without these specific details, that the embodiments are not limited to the depicted embodiments, and that the embodiments may be practiced in a variety of alternative embodiments. In other instances, well known methods, procedures, and components have not been described in detail.

Further, various operations may be described as multiple discrete steps performed in a manner that is helpful for understanding the embodiments. However, the order of description should not be construed as to imply that these operations need be performed in the order they are presented, or that they are even order-dependent. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated.

Figure 1:
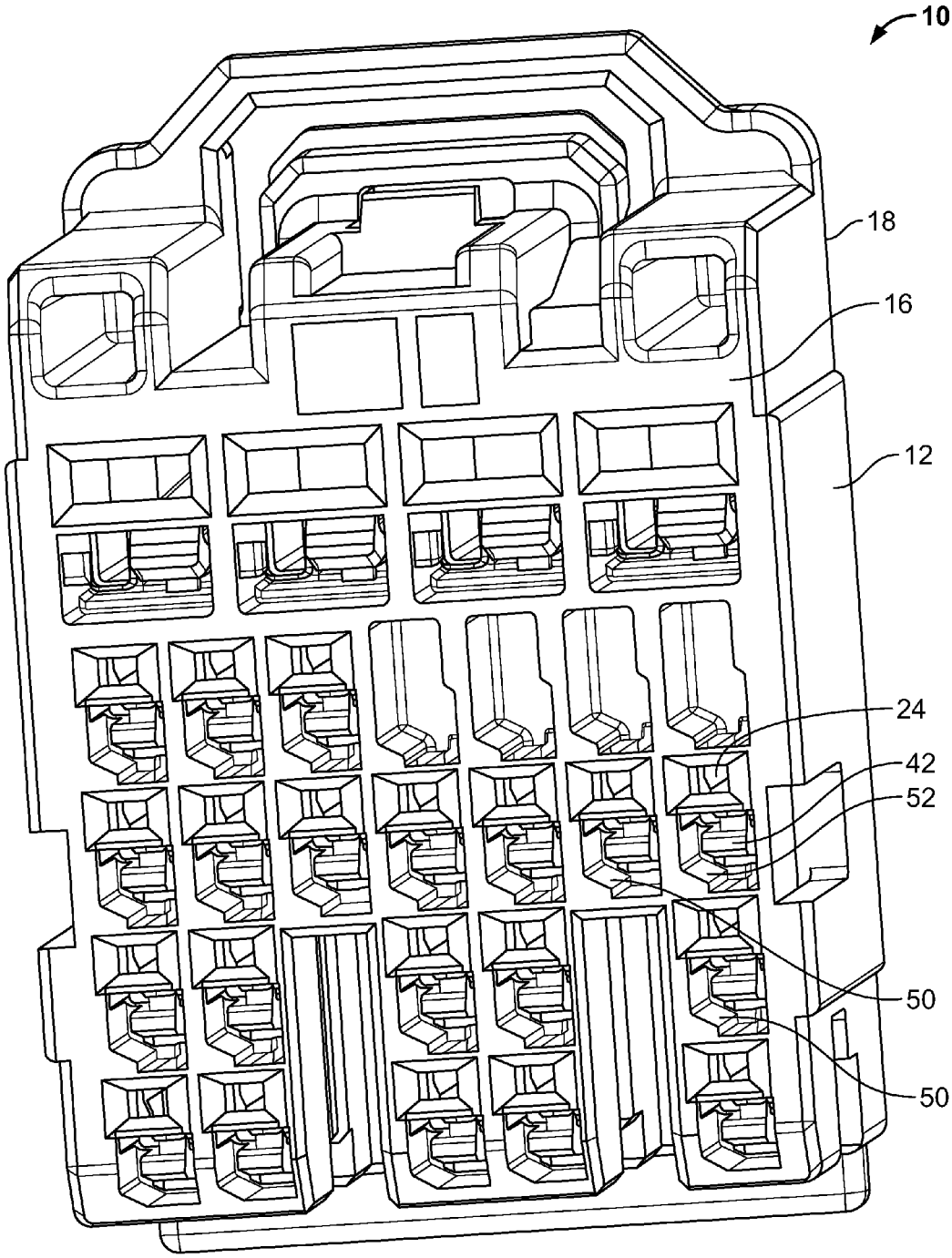
FIG. 1 is a perspective view of an electrical connector assembly according to certain aspects of an exemplary embodiment of the present invention.

Referring now to FIG. 1, an exemplary embodiment of an electrical connector 10 is shown. The electrical connector 10 may, for example, be in the form of a plug connector configured to mate with a receptacle connector (not shown), as is well known in the art. Alternatively, the electrical connector may be in the form of a receptacle connector configured to mate with a plug connector, or other types of connectors which are known in the industry. In the embodiment shown, the electrical connector 10 has a housing 12 with a front or mating end 16 and a rear end 18.

Terminal receiving passages 20 extend between the front and rear ends 16, 18 of the housing 12. Each passage 20 is configured to receive and support an electrical contact terminal 22 (FIG. 2) within the housing 12. The passages 20 present front openings 24, which are arranged in a predetermined pattern to allow the terminals 22 to mate with the mating terminals (not shown) carried by another connector (not shown), such as a receptacle. The passages 20 also include rear openings 26 (FIG. 2), which are configured to allow the terminals 22 to be inserted into the housing 12 during assembly of the connector 10, as is explained in greater detail below. Conductors 28 (FIG. 2), such as wires from a wiring harness or another device (not shown), are connected to the rear ends of terminals 22 and extend from the rear openings in the housing. The particular configuration of the terminal receiving passages and the pattern in which the passages are merely exemplary embodiments and are not meant to be limiting.

Referring to FIGS. 2 through 6, each passage 20 includes a terminal resilient or deflectable latch 30 for securing a respective terminal 22 within the passage 20. The terminal latch 30 includes an arm or beam 32 extending longitudinally within a respective passage 20. The beam 32 has a rear end 34 connected to housing 12 and front, free standing end 36 which can be pivoted outwardly in the passage 20 to allow a terminal 22 to be inserted into the passage 20. A longitudinal space 40 extends below each of the beams 32 of the latches 30. The longitudinal space 40 is a portion of an opening 42 which extends through the front end 16 of the housing 12. In the illustrated exemplary embodiment, the latches 30 are arranged in essentially the same relative position in each terminal passage 20. However, the terminal latches 30 for respective passages 20 may be positioned adjacent to one another or may be offset from one another.

Figure 2:
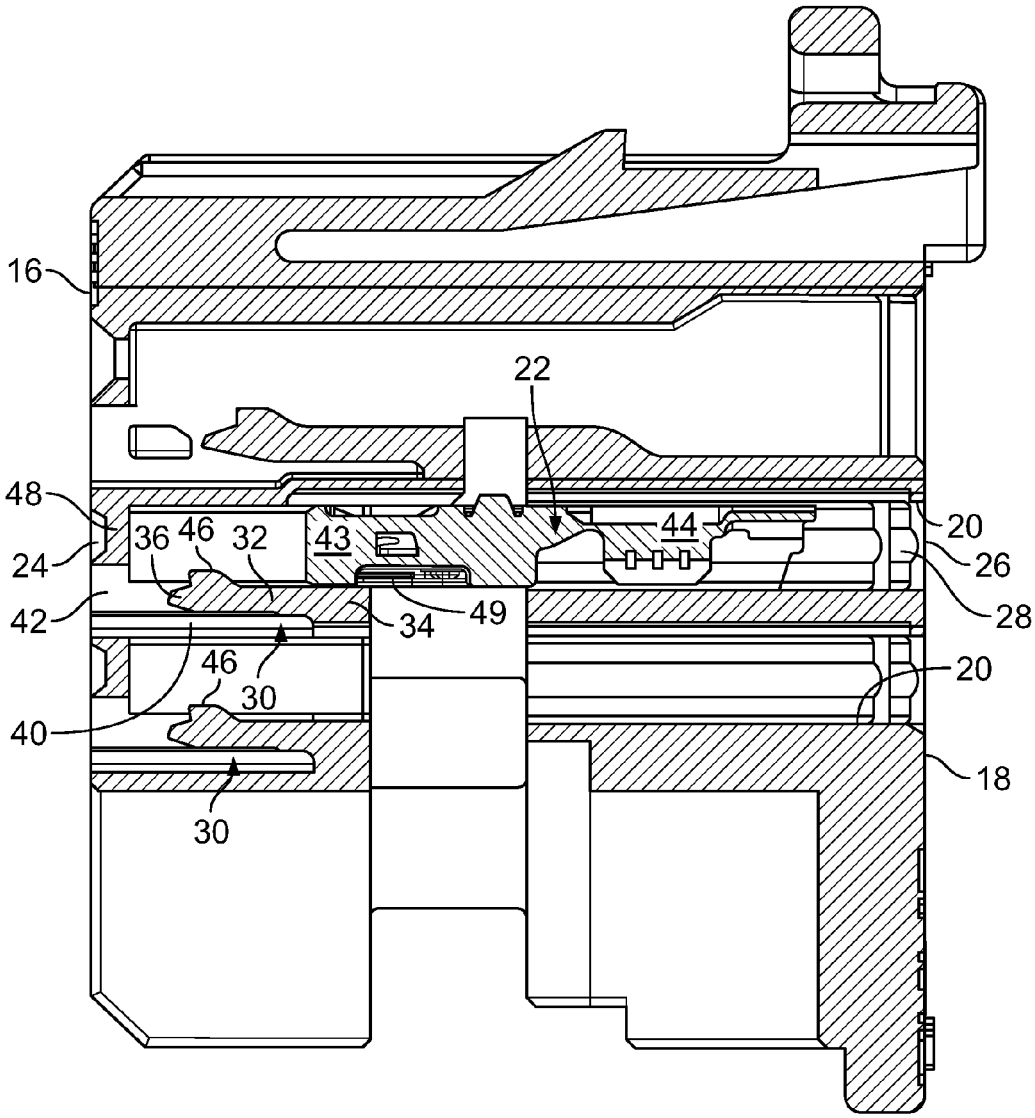
FIG. 2 is a cross-section view of the connector assembly showing an electrical terminal partially inserted into the housing.
Figure 3:
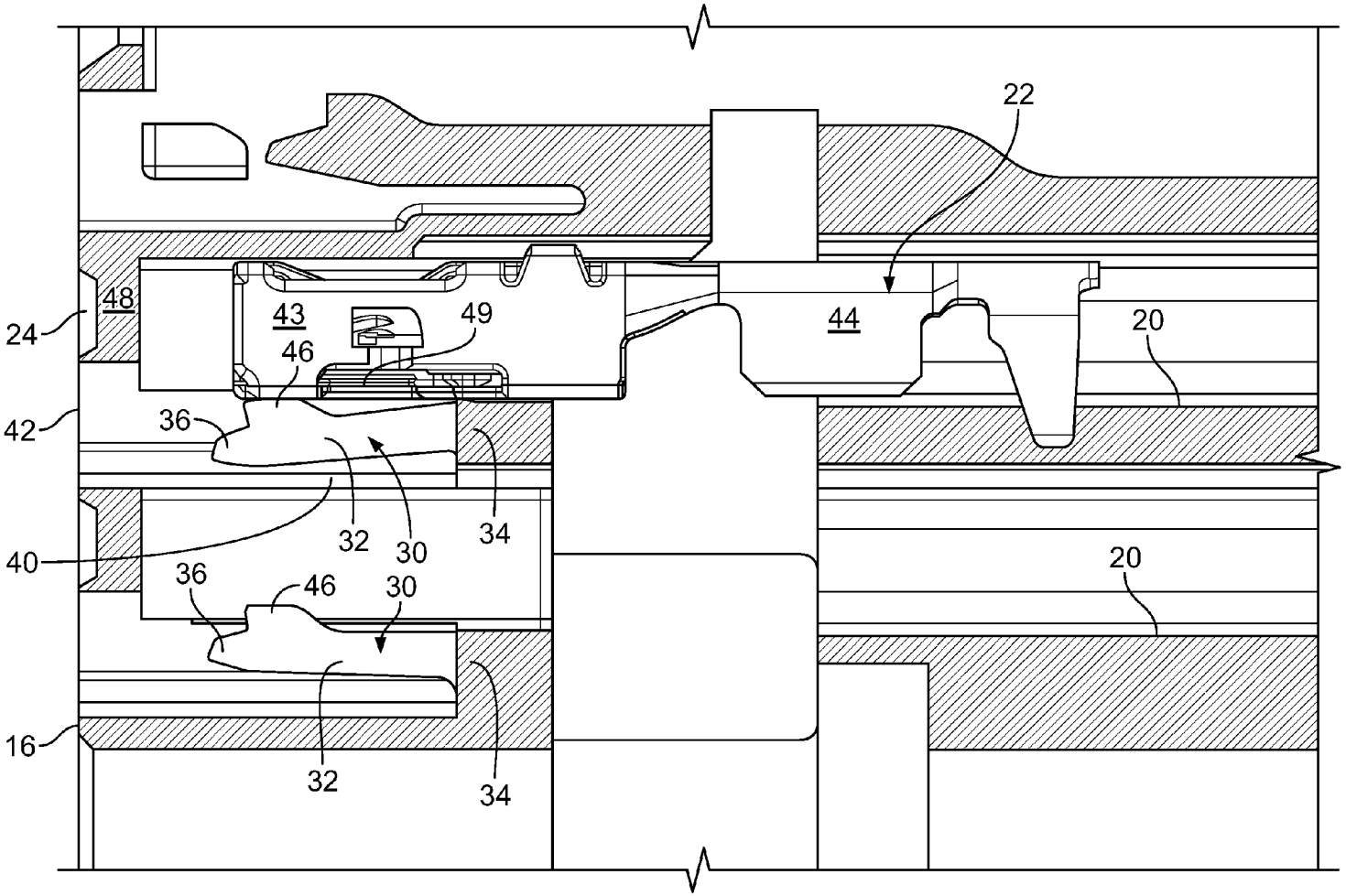
FIG. 3 is a cross-sectional view similar to FIG. 2, showing the terminal partially inserted into the housing such that a latching arm is deflected.
Figure 6:
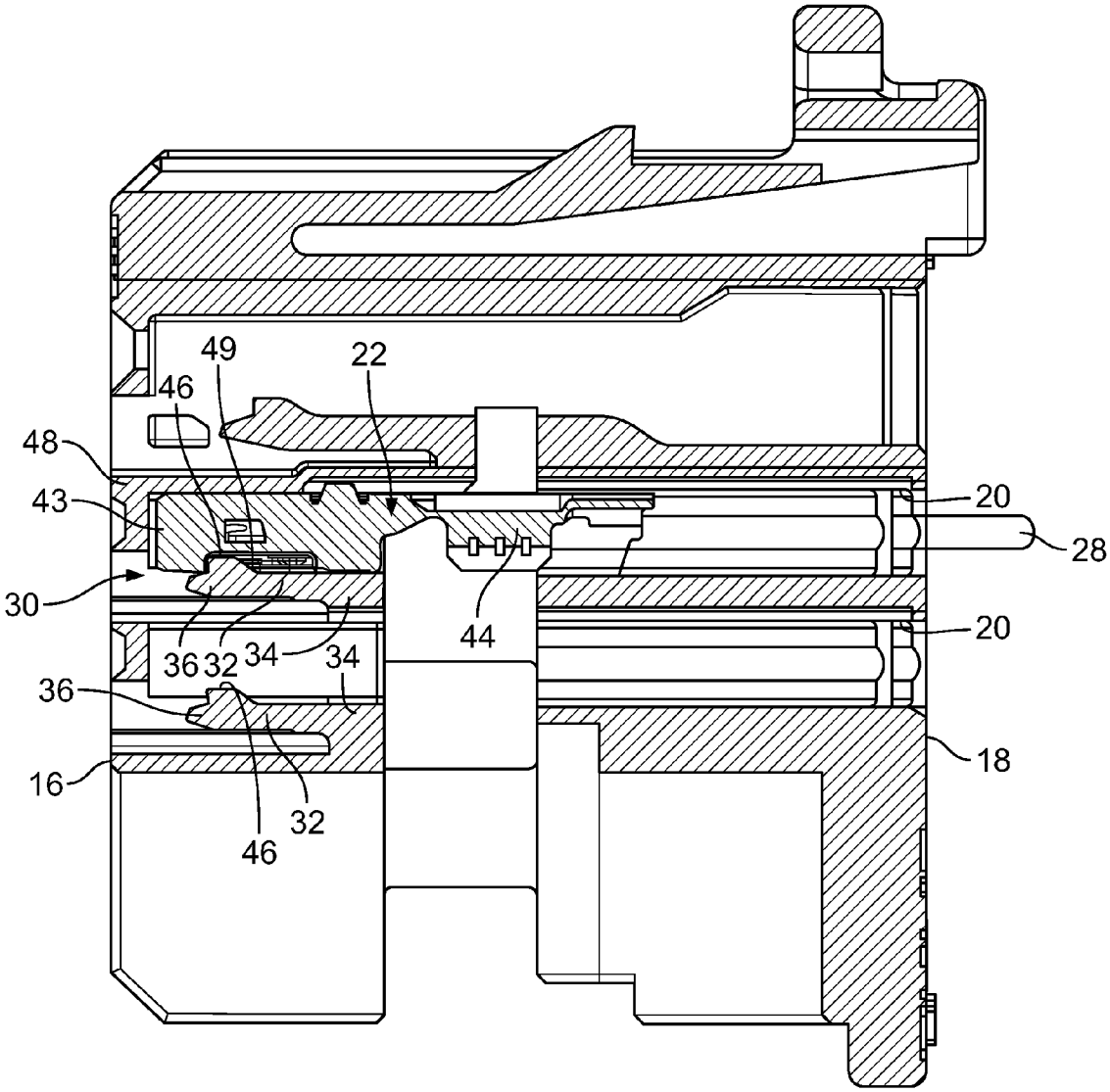
FIG. 6 is a cross-section view similar to FIG. 2, showing an electrical terminal fully inserted into the housing.

During assembly, the terminals 22, which have previously been secured to the conductors 28, are inserted into the passages 20 through the rear openings 26. As can be seen in FIG. 2, each of the terminals 22 includes a front portion 43, which is configured to receive a mating contact, such as, for example, a pin from another connector. Each terminal 22 also includes a rear portion 44, which is configured to be secured to one of the conductors 28. As each terminal 22 is inserted into a respective passage 20, the front portion 43 of the terminal 22 engages against the inner face of latch beam 32. The inner face of the latch beam 32 may be beveled as shown to ease insertion of the terminal 22 into the passage 20. Continued inward movement of the terminal 22 biases the latch beam 32 laterally outwardly in the passage 20. The terminal 22 continues to move longitudinally inwardly into the passage 20 until its front portion 43 moves past a locking finger 46 formed on the front end 36 of the latch beam 32. Once the front portion 43 of the terminal 22 moves beyond the locking finger 46, the latch beam 32 springs laterally inwardly in the passage 20 to secure the terminal 22 within the passage, as is shown in FIG. 6. The terminal 22 is restrained in passage 20 between the locking finger 46 and a protrusion 48 formed on the front end of the passage 20. The terminal 22 may include an opening 49 configured to receive the locking finger 46.

Figure 4:
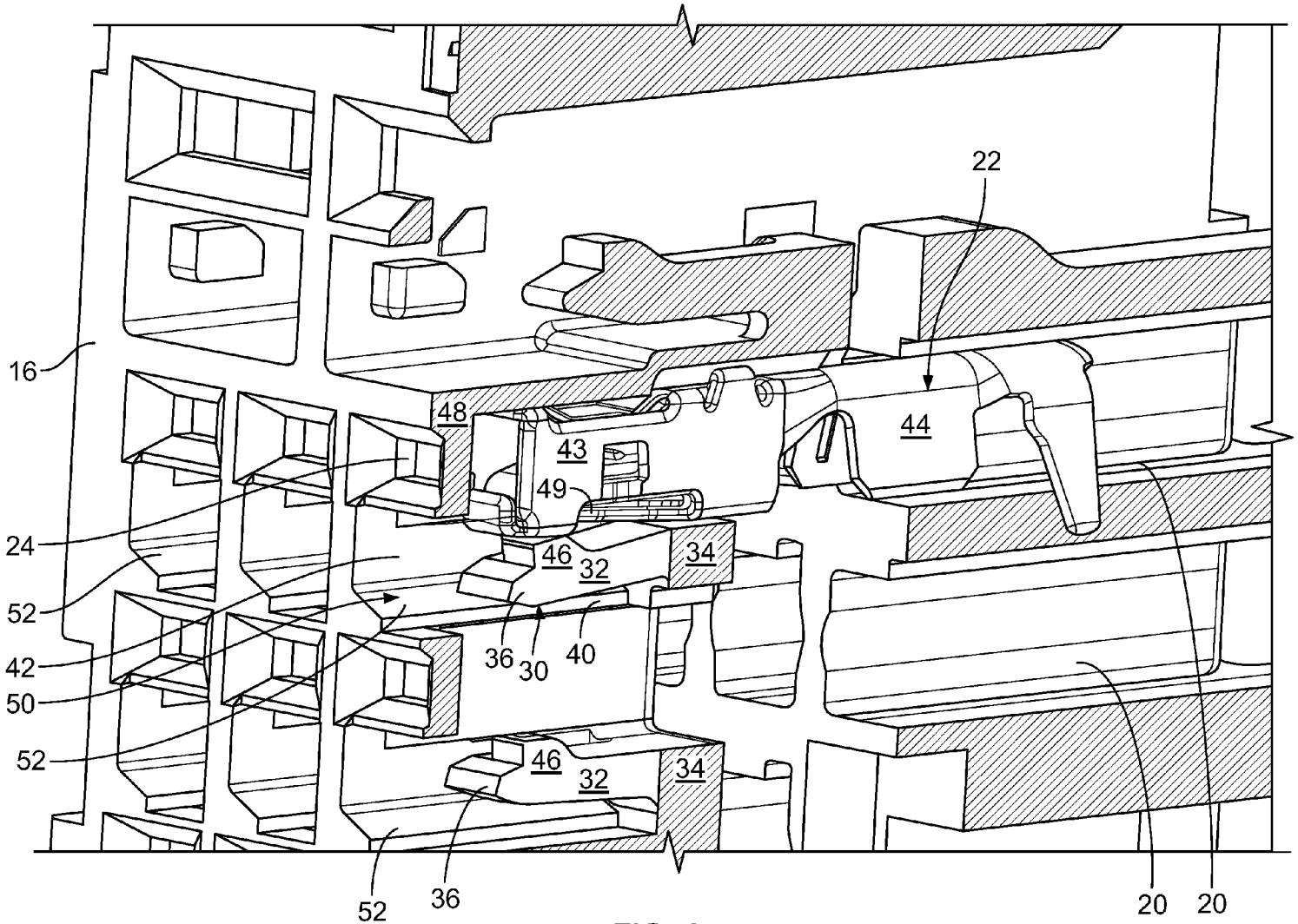
FIG. 4 is a perspective sectional view of the connector assembly with the electrical terminal partially inserted into the housing such that a latching arm is deflected as shown in FIG. 3.
Figure 5:
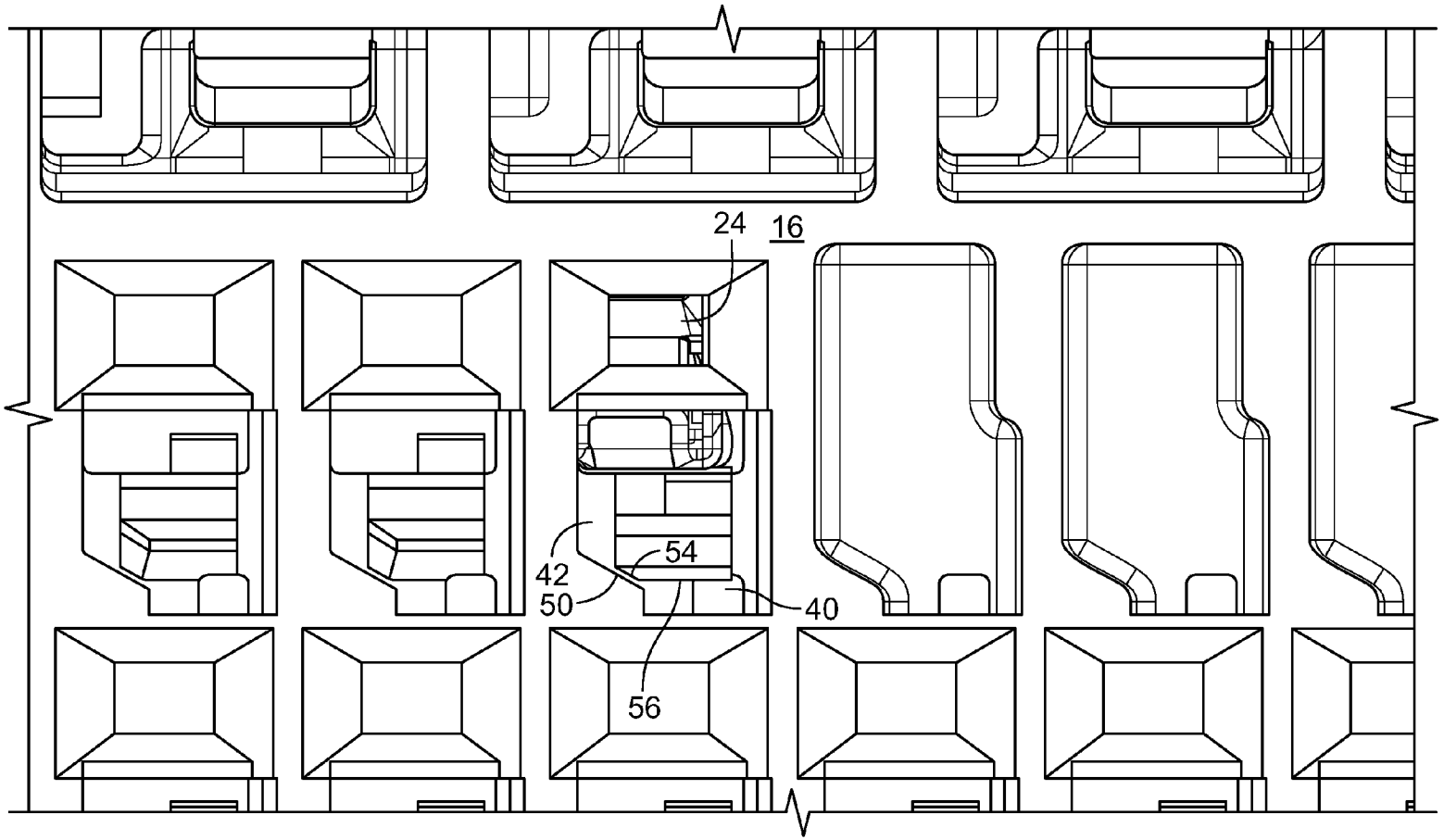
FIG. 5 is a front view of the connector assembly with the electrical terminal partially inserted into the housing such that a latching arm is deflected as shown in FIG. 4.

As best shown in FIGS. 4 and 5, at least one projection 50 extends into each passage 20 proximate opening 42. The projection extends from a side wall or surface of the passage 20 and is dimensioned to cooperate with the latch beam or arm 32 to limit outward travel of the terminal latch 30, thereby preventing the latch 30 from being overstressed during removal of the terminal 22 from the passage, as will be more fully described. The projection may also be a portion of the side wall which projects into the passage 20. In the exemplary embodiment shown, the projection 50 is a portion of the side wall of the passage and has a beveled surface 52 which cooperates with a beveled or side surface 54 (FIG. 5) of the latch arm 32. Side surface 54 is defined to be a surface other than the bottom surface of the latch arm 32. However, other configurations of the projection 50 may be incorporated. In addition, more than one projection 50 may be provided in each passage 20.

Referring to FIG. 5, the incorporation of the beveled edges 52 of the projections 50 and the beveled edges 54 of the latch arms 32 allow the projections 50 to cooperate with a side or sloped surface of the latch arms 32 which is above a bottom surface 56 of the latch arms 32. Consequently, the projections 50 are positioned on the side walls of the passages 20 above the position of the bottom wall 56 when the latch arms 32 are resiliently deflected during repair or replacement of the terminals. This allows the projections 50 to cooperate with the latch arms 32 to prevent overstress of the latch arms 32 while allowing the terminals to be closely spaced in the direction X of FIG. 1, as the projections 50 do not require any additional space in the X direction.

The front end of the terminal latch 30 can be accessed through the front opening 42 which is positioned adjacent to or in cooperation with opening 24 of a respective terminal passage 20. A tool such as, but not limited to, a pick, can be inserted through the front opening 42 and used to bias the terminal latch 30 outwardly so that the terminal 22 can be removed from the passage 20.

In operation, the positioning of the projections 50 and the spacing between the projections 50 and the latch arm 32 is dimensioned to permit the terminal latches 30 to flex outwardly in their respective passages 20 a sufficient distance to allow the terminals 22 to be inserted into the passage 20. In this position the projections 50 cooperate with side surfaces 54 of the latch arms 32 to function as overstress mechanisms to prevent the latches 30 from flexing beyond a predetermined point, thereby preventing overstressing of the latch which could cause the latch to break.

In connectors known in the prior art, the connector housing of the connector has terminal passages carrying respective terminal latches. The terminal latches have an overstress wall which extends behind the latches; there is no opening 42 or projections 50. The overstress wall is provided to cooperate with a bottom surface of the terminal latches to prevent the terminal latches from overstressing, e.g., from flexing outwardly too far as the terminals are inserted into and/or removed from the passages. While these prior art connectors have been effective, the use of the overstress wall cannot be used in application in which the terminals are required to be closely spaced together, as the space requirements for the wall are relatively large in comparison to the spacing of the terminals and terminal passages. In contrast, a connector constructed according to present disclosure provides a substantial space reduction in comparison with this prior connector design. The reduction of space is a result of the projections 50 extending from a side surface or wall of the terminal passage 20, allowing for the longitudinal space 40 and opening 42 to extend from a first terminal passage 20 to an adjacent second terminal passage 20. For example, if the overstress wall of the prior art is 1.6 mm wide, the use of the projections 50 allows the wall to be eliminated, thereby allowing the terminals to be spaced 1.6 mm closer to each other. Therefore, by incorporating the projection overstress feature, it is possible to reduce the size of the connector when compared to the prior art connector.

In addition, the complementary configuration of the surface 52 of the projection 50 and the surface 54 of the arm 32 allows for additional reduction in space and also allows for ease of manufacture of the connector.

In alternate embodiments, a terminal position assurance device may be positioned over the front or mating end 16 of the housing 12 of the connector 10. The terminal position assurance device would have locking arms which would extend through the openings 42 and be positioned under the latch arms 32 to prevent the movement of the latch arms 32, thereby preventing the inadvertent or unwanted removal of the terminals 22. The terminal position assurance device operates in a manner known in the art. Additionally, a secondary lock may be provide to help secure the terminals 22 in the passages 20.

While the written description has referred to a preferred embodiment, it will be understood by those skilled in the art that various changes and modifications may be made and equivalents may be substituted for elements thereof without departing from the patentable scope as defined by the claims. Therefore, it is intended that the patentable scope not be limited to the particular embodiments disclosed as the best mode contemplated, but rather other embodiments are intended to be within the scope of the claims if they have structural elements that do not differ from the literal language of the claims, or if they include equivalent structural elements with insubstantial differences from the literal language of the claims.

The invention claimed is:

1. An electrical connector comprising:

a housing having a plurality of terminal passages, each terminal passage configured to permit an electrical terminal to be inserted into the passage and a deflectable latch for securing the terminal within the passage;

openings provided proximate the deflectable latches, each opening extending from a first terminal passage of the plurality of terminal passages to an adjacent second terminal passage;

projections provided in the plurality of terminal passages proximate the openings, at least one projection extending into each terminal passage, the at least one projection positioned to cooperate with a side surface of a respective deflectable latch to prevent the deflectable latch from being overstressed;

wherein the openings and the projections allow the terminal passages to be closely spaced thereby reducing the size of the connector while providing overstress protection for the deflectable latches.

2. An electrical connector as set forth in claim 1, wherein the deflectable latches have latch arms which extend longitudinally within the terminal passages, the latch arms have rear ends connected to a housing of the connector and front, free standing ends which can be pivoted outwardly in the terminal passages into the openings to allow the terminals to be inserted into the terminal passages.

3. An electrical connector as set forth in claim 2, wherein the openings include longitudinal spaces which extend below the latch arms, the free standing ends can be pivoted outwardly in the terminal passages into the longitudinal spaces of the openings to allow the terminals to be inserted into the terminal passages.

4. An electrical connector as set forth in claim 2, wherein the projections extend from a side surfaces of the terminal passages and are configured to cooperate with the latch arms to limit outward travel of the terminal latches, thereby preventing the terminal latches from being overstressed during removal of the terminals which may be positioned in the terminal passages.

5. An electrical connector as set forth in claim 1, wherein the projections have beveled surfaces, the beveled surfaces of the projections engage the deflectable latches to prevent the overstress of the deflectable latches during the removal of the terminals positioned in the terminal passages.

6. An electrical connector as set forth in claim 5, wherein the deflectable latches have latch arms with beveled surfaces, the beveled surfaces of the projections and the beveled surfaces of the latch arms engage to prevent the overstress of the deflectable latches during the removal of the terminals, whereby the beveled edges of the projections and the beveled edges of the latch arms allow the projections to cooperate with the beveled edge of the latch arms which is above a bottom surface of the latch arms thereby allowing the projections to cooperate with the latch arms to prevent overstress of the latch arms while allowing the terminal passages to be closely spaced.

7. An electrical connector as set forth in claim 1, wherein the openings extend through a front end of the connector to allow a tool to be inserted through the openings and used to bias the latch arms of the deflectable latches outwardly so that the terminals positioned in the terminal passages can be removed.

8. An electrical connector comprising:

a housing having a plurality of terminal passages, each terminal passage configured to permit an electrical terminal to be inserted into the passage and a deflectable latch for securing the terminal within the passage;

openings provided proximate the deflectable latches, each opening extending from a first terminal passage of the plurality of terminal passages to an adjacent second terminal passage;

projections extending from side surfaces of the terminal passages, at least one projection extending into each terminal passage, the at least one projection positioned to cooperate with a side surface of a respective deflectable latch to prevent the deflectable latch from being overstressed;

wherein the openings and the projections allow the terminal passages to be closely spaced thereby reducing the size of the connector while providing overstress protection for the deflectable latches.

9. An electrical connector as set forth in claim 8, wherein the deflectable latches have latch beams which extend longitudinally within the terminal passages, the latch beams have rear ends connected to a housing of the connector and front, free standing ends which can be pivoted outwardly in the terminal passages into the openings to allow the terminals to be inserted into the terminal passages.

10. An electrical connector as set forth in claim 9, wherein the openings include longitudinal spaces which extend below the latch beams, the free standing ends can be pivoted outwardly in the terminal passages into the longitudinal spaces of the openings to allow the terminals to be inserted into the terminal passages.

11. An electrical connector as set forth in claim 8, wherein the projections have beveled surfaces, the beveled surfaces of the projections engage the deflectable latches to prevent the overstress of the deflectable latches during the removal of the terminals positioned in the terminal passages.

12. An electrical connector as set forth in claim 11, wherein the deflectable latches have latch beams with beveled surfaces, the beveled surfaces of the projections and the beveled surfaces of the latch beams engage to prevent the overstress of the deflectable latches during the removal of the terminals, whereby the beveled edges of the projections and the beveled edges of the latch beams allow the projections to cooperate with the beveled edge of the latch beams which is above a bottom surface of the latch beams thereby allowing the projections to cooperate with the latch beams to prevent overstress of the latch beams while allowing the terminal passages to be closely spaced.

13. An electrical connector as set forth in claim 8, wherein the openings extend through a front end of the connector to allow a tool to be inserted through the openings and used to bias the latch beams of the deflectable latches outwardly so that the terminals positioned in the terminal passages can be removed.

14. An electrical connector as set forth in claim 8, wherein the projections in the plurality of terminal passages are positioned proximate the openings.

15. An electrical connector comprising:

a housing having a plurality of terminal passages, each terminal passage configured to permit an electrical terminal to be inserted into the passage and a deflectable latch for securing the terminal within the passage;

openings provided proximate the deflectable latches, each opening extending from a first terminal passage of the plurality of terminal passages to an adjacent second terminal passage;

projections extending from side surfaces of the terminal passages, the projections having beveled surfaces, the beveled surfaces of the projections engage the deflectable latches to prevent the overstress of the deflectable latches during the removal of the terminals;

wherein the openings and the projections allow the terminal passages to be closely spaced thereby reducing the size of the connector while providing overstress protection for the deflectable latches.

16. An electrical connector as set forth in claim 15, wherein the projections in the plurality of terminal passages are positioned proximate the openings.

17. An electrical connector as set forth in claim 16, wherein the deflectable latches have latch arms which extend longitudinally within the terminal passages, the latch arms have rear ends connected to a housing of the connector and front, free standing ends which can be pivoted outwardly in the terminal passages into the openings to allow the terminals to be inserted into the terminal passages.

18. An electrical connector as set forth in claim 17, wherein the openings include longitudinal spaces which extend below the latch arms, the free standing ends can be pivoted outwardly in the terminal passages into the longitudinal spaces of the openings to allow the terminals to be inserted into the terminal passages.

19. An electrical connector as set forth in claim 18, wherein the latch arms with beveled surfaces, the beveled surfaces of the projections and the beveled surfaces of the latch arms engage to prevent the overstress of the deflectable latches during the removal of the terminals, whereby the beveled edges of the projections and the beveled edges of the latch arms allow the projections to cooperate with the beveled edge of the latch arms which is above a bottom surface of the latch arms thereby allowing the projections to cooperate with the latch arms to prevent overstress of the latch arms while allowing the terminal passages to be closely spaced.

20. An electrical connector as set forth in claim 19, wherein the openings extend through a front end of the connector to allow a tool to be inserted through the openings and used to bias the latch arms of the deflectable latches outwardly so that the terminals positioned in the terminal passages can be removed.

* * * * *